United States Patent [19]

Hartmann et al.

[11] 4,294,873

[45] Oct. 13, 1981

[54] MANUFACTURE OF PAPER HAVING A HIGH DRY STRENGTH AND A LOW WET STRENGTH

[75] Inventors: Juergen Hartmann, Ludwigshafen; Joachim Stedefeder, Lampertheim; Walter Denzinger; Sigberg Pfohl, both of Speyer, all of Fed. Rep. of Germany

[73] Assignee: BASF Aktiengesellschaft, Ludwigshafen, Fed. Rep. of Germany

[21] Appl. No.: 109,315

[22] Filed: Jan. 3, 1980

[30] Foreign Application Priority Data

Jan. 27, 1979 [DE] Fed. Rep. of Germany ..... 2903218

[51] Int. Cl.[3] ..... B05D 3/02; B32B 23/08; B32B 27/10

[52] U.S. Cl. ..... 427/391; 428/514; 428/511; 260/29.6 H

[58] Field of Search ..... 427/391; 428/514, 511; 260/29.6 H

[56] References Cited

FOREIGN PATENT DOCUMENTS

| | | |
|---|---|---|
| 931044 | 2/1948 | France . |
| 1216337 | 12/1970 | United Kingdom . |
| 2006294 | 5/1979 | United Kingdom . |

*Primary Examiner*—Michael R. Lusignan

*Attorney, Agent, or Firm*—Oblon, Fisher, Spivak, McClelland & Maier

[57] ABSTRACT

A process for the manufacture of paper having a high dry strength and a low wet strength, by treating the surface of the paper with an aqueous solution of an alkali metal and/or alkaline earth metal salt of a polymer of (a) from 91 to 100% by weight of acrylic acid and/or methacrylic acid and (b) from 0 to 9% by weight of acrylonitrile, methacrylonitrile, acrylamide, methacrylamide, vinyl acetate, maleic anhydride, diisobutylene, an ester of acrylic acid and/or an ester of methacrylic acid, which has a viscosity of from 5 to 100 mPas in 2% strength aqueous solution at 20° C., and drying the impregnated paper. The polymer is generally employed in an amount of from 1 to 4% by weight, based on dry paper, and increases the dry strength of the paper without substantially increasing the wet strength.

5 Claims, No Drawings

MANUFACTURE OF PAPER HAVING A HIGH DRY STRENGTH AND A LOW WET STRENGTH

German Pat. No. 2,741,753 proposes a process for the manufacture of paper having a high dry strength and a low wet strength by treating the surface of the paper with a water-soluble salt of a polymer based on ethylenically unsaturated carboxylic acids, wherein the polymer salt used is a water-soluble alkali metal salt and/or alkaline earth metal salt of a copolymer of (a) from 90 to 30% by weight of acrylic acid and/or methacrylic acid and (b) from 10 to 70% by weight of acrylonitrile, methacrylonitrile, acrylamide and/or methacrylamide, with or without (c) up to 30% by weight of an acrylic acid ester or methacrylic acid ester, which has a viscosity of from 5 to 100 mPas (measured on a Brookfield viscometer at 20 revolutions per minute) in 2% strength aqueous solution at 20° C.

We have found that paper having a high dry strength and a low wet strength is also obtained by treating the surface of the paper with an aqueous solution of a polymer salt, if a water-soluble alkali metal salt and/or alkaline earth metal salt of a polymer of (a) from 91 to 100% by weight of acrylic acid and/or methacrylic acid and (b) from 0 to 9% by weight of acrylonitrile, methacrylonitrile, acrylamide, methacrylamide, vinyl acetate, maleic anhydride, diisobutylene, and acrylic acid ester and/or methacrylic and ester is used.

The viscosity of the polymer salt is from 5 to 100 mPas (measured on a Brookfield viscometer at 20 revolutions per minute) in 2% strength aqueous solution at 20° C.

The homopolymers and copolymers are prepared in accordance with conventional methods by polymerizing the monomers, cf. U.S. Pat. Nos. 2,819,189 and 2,999,038. In these methods, the monomers, or mixtures of monomers, are polymerized continuously or batchwise with the aid of free radical polymerization initiators, preferably in water. If an alkali metal salt and/or alkaline earth metal salt of acrylic acid or methacrylic acid is employed at the polymerization stage, the copolymer salt solutions to be used according to the invention are obtained directly. Acrylic acid and/or methacrylic acid can be copolymerized with the corresponding amides or nitriles in water by a precipitation polymerization method. The copolymers obtained can be directly neutralized with an alkali metal hydroxide and/or alkaline earth metal hydroxide.

However it is also possible to carry out the polymerization with an aqueous solution of acrylic acid or methacrylic acid which has been neutralized to the extent of from 10 to 40% by means of ammonium ions, alkali metal ions or alkaline earth metal ions, and subsequently to neutralize the resulting aqueous polymer solution completely with alkali metal bases and/or alkaline earth metal bases. A process of preparation for the copolymers, in which acrylic acid or methacrylic acid partially neutralized with ammonium ions is employed, is disclosed in German Published Application DAS No. 2,004,676. The polymers can also be prepared by the inverse suspension polymerization process disclosed in German Pat. No. 1,081,228 and by the inverse emulsion polymerization process disclosed in German Pat. No. 1,089,173.

However, it is also possible to isolate the homopolymer or copolymer obtained by precipitation polymerization in water, dry it and mix it with one or more dry alkali metal hydroxides and/or alkaline earth metal hydroxides or oxides in powder form. These powder mixtures can then readily be dissolved in water, giving a clear solution.

If the polymerization has not been carried out with an alkali metal salt and/or alkaline earth metal salt of acrylic acid or methacrylic acid, the homopolymer or copolymer is neutralized, after the polymerization, by means of an alkali metal hydroxide or alkaline earth metal hydroxide or oxide. The sodium, potassium, calcium and magnesium salts of the above copolymers are of particular importance. However, for the purposes of the invention the alkali metal salts do not include the ammonium salts of the copolymers. The polymers contain from 91 to 100, preferably from 95 to 100, % by weight of acrylic acid and/or methacrylic acid and from 0 to 9, preferably up to 5, % by weight of acrylonitrile, methacrylonitrile, acrylamide, methacrylamide, vinyl acetate, maleic anhydride, diisobutylene, esters of acrylic acid and/or esters of methacrylic acid. The esters are preferably derived from monohydric primary alcohols of 1 to 4 carbon atoms. The calcium salts and magnesium salts of homopolymers of acrylic acid and of methacrylic acid are of particular importance for the process according to the invention.

Preferably, calcium and magnesium salts, and mixtures of alkaline earth metal salts and alkali metal salts, of homopolymers of acrylic acid or of methacrylic acid, or of acrylic acid/acrylamide, acrylic acid/acrylonitrile, acrylic acid/methacrylic acid/acrylamide or acrylic acid/acrylamide/methacrylamide copolymers are used. At least 30% of the carboxyl groups of the polymers are neutralized with alkaline earth metal ions. The degree of neutralization is in general from 70 to 100%. The ratio of alkaline earth metal salts to alkali metal salts is preferably 30–50:70–50.

A 2% strength aqueous solution of the alkali metal salts or alkaline earth metal salts to be used according to the invention has a viscosity of from 5 to 100, preferably from 10 to 30, mPas (Brookfield, 20 rpm ) at 20° C. The pH of the copolymer salt solution is from 4.0 to 10.0.

The water-soluble alkali metal salts and alkaline earth metal salts of the relevant polymers are applied, to paper, in the form of an aqueous solution of from 1 to 10% strength. The paper can be impregnated with the solution of the alkali metal salt or alkaline earth metal salt of the copolymer, for example on a sizing press, or can be sprayed with a solution of the copolymer salt. The amount of solution picked up depends on the absorbency of the paper employed. To achieve a good increase in the dry strength of the paper, it suffices to impregnate the latter with from 1 to 4% by weight (based on solids) of the alkali metal or alkaline earth metal salts of the polymers.

The increase in strength of the paper is manifest directly after drying the paper under conventional conditions, for example at from 80° to 110° C. It is not necessary to age the impregnated paper. It is also a particular advantage that the alkali metal and alkaline earth metal salts of the polymers, used according to the invention, can be employed conjointly with the starch solutions commonly employed in industry, by using mixed solutions which contain from 2 to 10% by weight, preferably from 2 to 6% by weight, of starch, and from 1 to 3% by weight of the alkali metal and alkaline earth metal salts of polymers, used according to the invention.

It is possible to impregnate all conventional types of paper, for example writing paper, printing paper and packaging paper, with the products according to the invention. The papers can be produced from a variety of fibrous materials, eg. sulfite cellulose or sulfate cellulose (both of which may be bleached or unbleached), groundwood or waste paper. Use of the alkaline earth metal salts of copolymers of acrylic acid and/or methacrylic acid with the comonomers mentioned under (b) as surface coatings for paper results in an unexpected increase in the dry strength of the paper without a substantial increase in its wet strength. The dry strength characteristics of the paper which are substantially improved include, for example, the breaking length, the bursting pressure, the pick resistance, the tear propagation strength and the CMT value.

The Examples which follow illustrate the invention. In the Examples, parts and percentages are by weight. The viscosities mentioned were measured at 20° C. in a Brookfield viscometer at 20 revolutions per minute. The dry breaking length was measured according to DIN 53 112, page 1, and the wet breaking length according to DIN 53 112, page 2. The pick resistance of the paper was measured by the Dennison wax test.

EXAMPLE 1

A homopolymer of acrylic acid which has been obtained by polymerizing acrylic acid in aqueous solution with potassium peroxydisulfate as the catalyst is neutralized with magnesium hydroxide. A 2% strength aqueous solution of the magnesium salt of the homopolymer is prepared; it has a pH of 5.0.

A lignin-free, non-sized offset paper, weighing 80 g/m$^2$, which has been produced on a papermaking machine from a pulp of 25° SR freeness, and which contains 14% of ash (kaolin) and 2% of alum is impregnated with a 2% strength aqueous solution of the above magnesium salt of an acrylic acid homopolymer and is then dried at 100° C. Table 1 lists the viscosity of the solution used, the amount of pure polymer salt applied to the paper, based on the weight of the paper, and some properties of the resulting paper.

COMPARATIVE EXAMPLE 1a

The homopolymer of acrylic acid described in Example 1 is neutralized with ammonia instead of magnesium oxide and is used, as a 2% strength solution of pH 5.0, as an impregnating agent for the offset paper described in Example 1 (Table 1).

COMPARATIVE EXAMPLE 1b

The homopolymer of acrylic acid described in Example 1 is employed in a non-neutralized form, as a 2% strength aqueous solution of pH 2.5, to impregnate the offset paper described in Example 1. Table 1 lists the properties of the resulting paper, together with properties measured after treating the paper with water and then drying it; the latter constitute Comparative Example 1c.

TABLE 1

| | | Comparative Examples | | |
|---|---|---|---|---|
| | Example 1 (magnesium salt) | 1a (ammonium salt) | 1b (poly-acid | 1c (water) |
| Viscosity of the 2% strength aqueous solution [mPas] | 20 | 15 | 20 | 5 |
| Product pick-up (%) (solids, based on dry paper) | 1.70 | 1.75 | 1.70 | — |
| Dry breaking length (m) (machine direction) | 4,760 | 4,550 | 4,650 | 3,260 |
| Dennison test (wire side) | 16 | 16 | 16 | 6 |
| Wet breaking length (m) (machine direction) | 180 | 800 | 850 | 0 |

EXAMPLE 2

A copolymer of 95% of acrylic acid and 5% of acrylamide (prepared by polymerizing acrylic acid and acrylamide in aqueous solution, using potassium peroxydisulfate as the catalyst) is converted to the calcium salt (pH 6.0) by reaction with calcium hydroxide. A 2% strength solution of this copolymer salt is applied to a lignin-free, non-sized offset paper which weighs 80 g/m$^2$, contains 1% of alum and 10% of ash (kaolin) and has been produced from pulp of 25° SR freeness.

The impregnated paper is dried at 100° C. Further data concerning the impregnation solution, and the properties of the impregnated paper, are shown in Table 2.

COMPARATIVE EXAMPLE 2a

The copolymer of 95% of acrylic acid and 5% of acrylamide, described in Example 2, is neutralized with ammonia instead of calcium hydroxide and is used, as a 2% strength aqueous solution at a pH of 6.0, to impregnate the offset paper described in Example 2 (Table 2).

COMPARATIVE EXAMPLE 2b

The copolymer of 95% of acrylic acid and 5% of acrylamide, described in Example 2, is used without neutralization, in the form of a 2% strength aqueous solution having a pH of 2.5, to impregnate the paper described in Example 2. The paper was dried at the same temperature as in Example 2. The results are shown in Table 2. For comparison, Table 2 also shows the values which are obtained if the paper described in Example 2 is impregnated with water and dried at 100° C.

TABLE 2

| | | Comparative Examples | | |
|---|---|---|---|---|
| | Example 2 (calcium salt) | 2a (ammonium salt) | 2b (poly-acid) | 2c (water) |
| Viscosity of the 2% strength aqueous solution [mPas] | 20 | 15 | 20 | 5 |
| Product pick-up (%) (solids, based on dry paper) | 1.40 | 1.45 | 1.40 | — |
| Dry breaking length (m) (machine direction) | 5,750 | 5,200 | 5,350 | 4,050 |
| Dennison test (wire side) | 16 | 12 | 14 | 7 |
| Wet breaking length (m) (machine | 0 | 550 | 550 | 0 |

TABLE 2-continued

| | Example 2 (calcium salt) | Comparative Examples 2a (ammonium salt) | 2b (poly-acid) | 2c (water) |
|---|---|---|---|---|
| direction) | | | | |

The Examples and Comparative Examples show that the polymer salts to be used according to the invention lead to a greater increase in the dry strength than do the corresponding ammonium salts or polyacids, without an undesirable increase in the wet strength of the paper.

We claim:

1. A process for the manufacture of paper having a high dry strength and a low wet strength which comprises treating the surface of paper with an aqueous solution of a water-soluble alkaline earth metal salt or a mixture of a water-soluble alkaline earth metal salt and an alkali metal salt, the ratio of alkaline earth metal salts to alkali metal salts being 30–50:70–50, of a polymer selected from the group consisting of homopolymer of acrylic acid, homopolymer of methacrylic acid, acrylic acid/acrylamide copolymer, acrylic acid/acrylonitrile copolymer, acrylic acid/methacrylic acid/acrylamide copolymer and acrylic acid/acrylamide/methacrylamide copolymer;

which has a viscosity of from 5 to 100 mPas (measured in a Brookfield viscometer at 20 revolutions per minute) in 2% by wt. strength aqueous solution at 20° C., and drying the paper.

2. A process as claimed in claim 1, wherein a calcium salt and/or magnesium salt is used as water-soluble polymer salt.

3. A process as claimed in claim 1, wherein a mixture of an alkali metal salt and an alkaline earth metal salt of the polymer is used.

4. A process as claimed in claim 1, wherein the polymer is a homopolymer of acrylic acid or methacrylic acid.

5. A process as claimed in claim 1, wherein the paper is impregnated with from 1 to 4% by weight of the copolymer salt, based on paper solids.

* * * * *